US008814032B2

(12) United States Patent
Li

(10) Patent No.: US 8,814,032 B2
(45) Date of Patent: Aug. 26, 2014

(54) LUNCH BOX

(76) Inventor: Hsin-Chieh Li, Changhua (TW)

( * ) Notice: Subject to any disclaimer, the term of this patent is extended or adjusted under 35 U.S.C. 154(b) by 5 days.

(21) Appl. No.: 13/533,577

(22) Filed: Jun. 26, 2012

(65) Prior Publication Data

US 2013/0161379 A1 Jun. 27, 2013

(30) Foreign Application Priority Data

Dec. 22, 2011 (TW) ..... 100224268 U

(51) Int. Cl.
*B65D 5/24* (2006.01)
*B65D 5/36* (2006.01)

(52) U.S. Cl.
USPC ..... 229/114; 229/117.07; 229/145

(58) Field of Classification Search
USPC ..... 229/113, 114, 117.01, 117.07, 117.08, 229/145
See application file for complete search history.

(56) References Cited

U.S. PATENT DOCUMENTS

| | | | | | |
|---|---|---|---|---|---|
| 1,090,558 | A | * | 3/1914 | Morrison et al. | 229/117.08 |
| 1,148,219 | A | * | 7/1915 | Cornell | 229/117.08 |
| 1,311,047 | A | * | 7/1919 | Cole | 229/117.07 |
| 1,947,199 | A | * | 2/1934 | Goodnow | 229/113 |
| 3,658,237 | A | * | 4/1972 | Engel | 229/145 |
| 6,126,065 | A | * | 10/2000 | Wee | 229/114 |

* cited by examiner

*Primary Examiner* — Gary Elkins
(74) *Attorney, Agent, or Firm* — Che-Yang Chen; Law Office of Michael Chen

(57) ABSTRACT

A lunch box includes a main body having a bottom portion, two side portions, a front portion and a back portion to define a receiving space, and a cover that covers upper portion of the main body extending from the back portion. Two side portions extend from bottom part of the junction of the front portion and back portion to form first shaping lines, and a retracting portion is formed between two side portions and two first shaping lines, and an expanding portion is formed at the junction of first shaping lines and the front portion. When the cover is bended down to cover the main body, the front portion is restored when the retracting portion rebounds, and the expanding portion is outwardly against the junction of the front cover and side covers to form a restricting position, so the box can be closed securely without external securing components.

5 Claims, 8 Drawing Sheets

LUNCH BOX

FIELD OF THE INVENTION

The present invention relates to a lunch box structure, and more particularly to a lunch box that does not need external components to complete the packaging process.

BACKGROUND OF THE INVENTION

Today, a large number of discarded lunch boxes create serious problems of waste handling and environmental protection, and the problems cannot be resolved for many years. Thus, after the styrofoam lunch boxes and utensils were banned, people started using paper to replace styrofoam. However, in conventional lunch box with a cover, the cover cannot be secured on the lunch box without a rubber band. Also, when there is still food in the lunch box, a user has to repeatedly use the rubber band to secure the cover on the lunch box after eating the food therein, and it is unlikely for the user to temporarily and effectively cover the food without using the rubber band. Furthermore, the lunch box may need more than one rubber band, so the costs might increase and unnecessary rubber wastes may be generated.

Therefore, there remains a need for a new and improved lunch box structure to achieve the goal of convenience and environmental protection to overcome the problems stated above.

SUMMARY OF THE INVENTION

The problem the present invention would like to solve is that in conventional lunch box with a cover, the cover cannot be secured on the lunch box without a rubber band. Also, when there is still food in the lunch box, a user has to repeatedly use the rubber band to secure the cover on the lunch box after eating the food therein, and it is unlikely for the user to temporarily and effectively cover the food without using the rubber band. Furthermore, the lunch box may need more than one rubber band, so the costs might increase and unnecessary rubber wastes may be generated.

To solve and overcome the problems stated above, the present invention provides a lunch box structure including a main body having a bottom portion, two side portions, a front portion and a back portion to define a receiving space. Two side portions of the main body extend from bottom part of the junction of the front portion and the back portion to form a first shaping line, and a retracting portion is formed between two side portions and two first shaping lines, and an expanding portion is formed at the junction of first shaping lines and the front portion. The front portion and two side portions are connected to outwardly form a tilted shape with an angle, and a cover that is used to cover an upper portion of the main body extends from the back portion, and cover connects with the back portion through an upper cover. Two side covers vertically extend from both sides of the upper cover of the cover, and are restricted outside two side portions of the main body. A front cover extends from front portion of the upper cover and covers outside the front portion of the main body, and the front cover forms a retracting tilted shape corresponding to the front portion of the main body. Also, two outer and upper portions of the front cover extend toward the center to form two second shaping lines, and a lifting portion is formed between a protruding portion of two second shaping lines and the front portion.

Comparing with the conventional arts, the present invention is advantageous because (i) two side portions of the present invention have two first shaping lines from the front portion and back portion and form the retracting portion. When the cover is bended down to cover the main body, two side portions are retracted when the front portion is pushed in corresponding to the first shaping lines. Meanwhile, side covers on both sides are independent from two side portions, so the user can easily close the lunch box at a better angle to increase the convenience of the lunch box; and (ii) when the cover is bended down to cover the main body, the front portion is restored when the retracting portion of the side portions rebounds, and the expanding portion is outwardly against the junction of the front cover and side covers to form a restricting position, so the lunch box can be closed securely without external securing components or rubber bands to reduce the material wastes and costs, and further achieve the goal of environmental protection.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1:
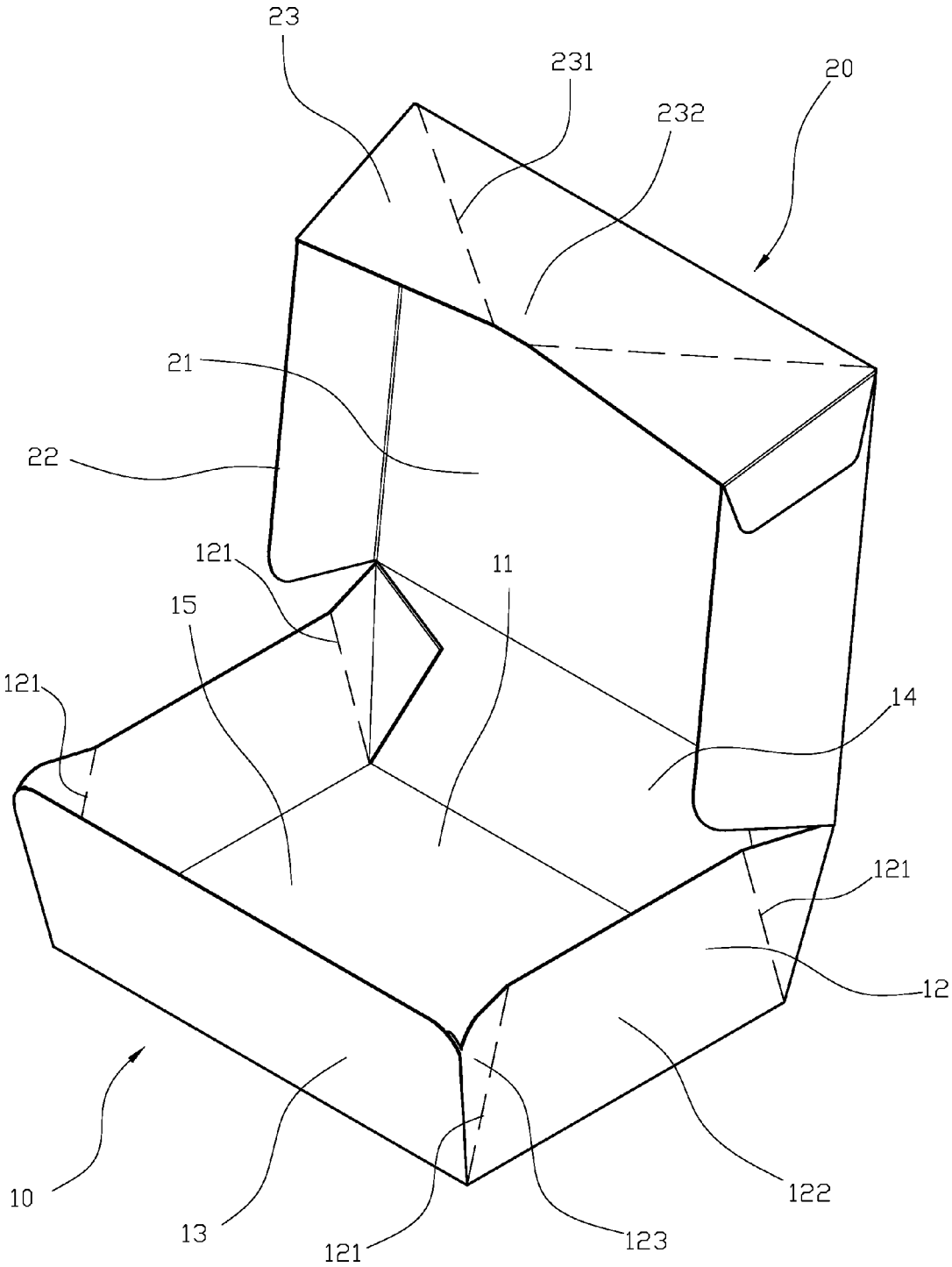
FIG. 1 illustrates a three-dimensional view in the present invention.
Figure 2:
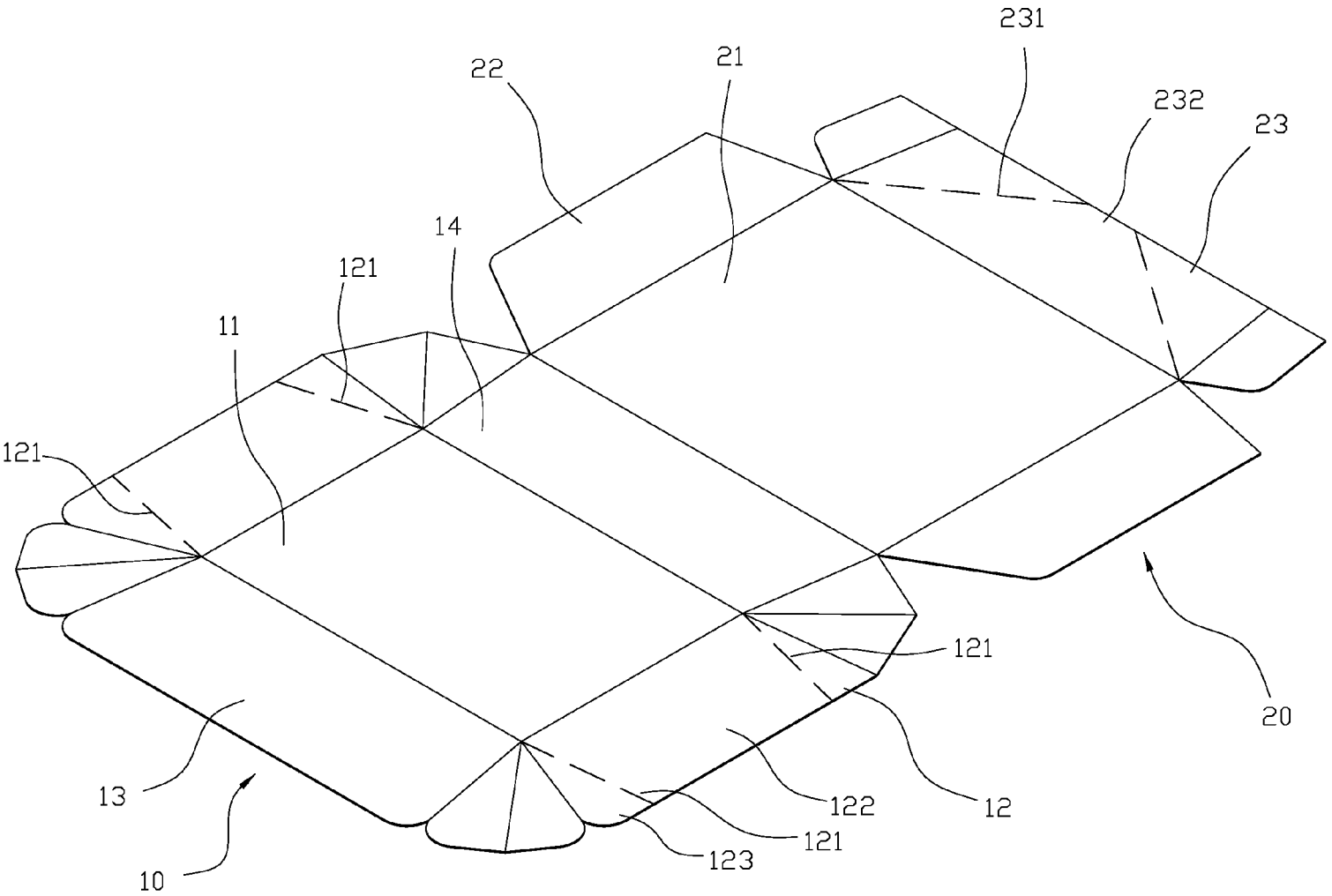
FIG. 2 illustrates an expanded view of the lunch box in the present invention.
Figure 3:
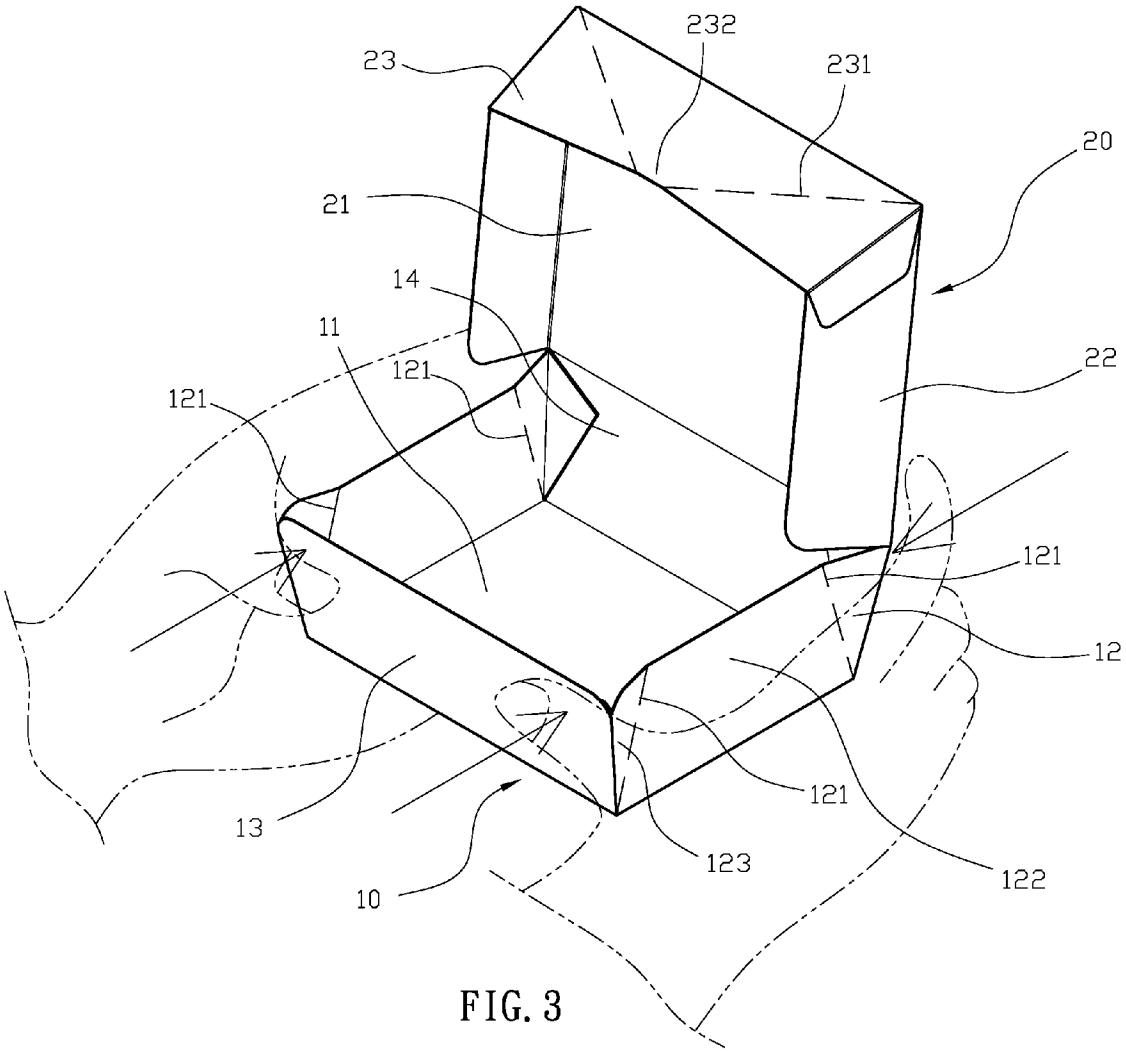
FIG. 3 illustrates an action view of the lunch box in the present invention.
Figure 4:
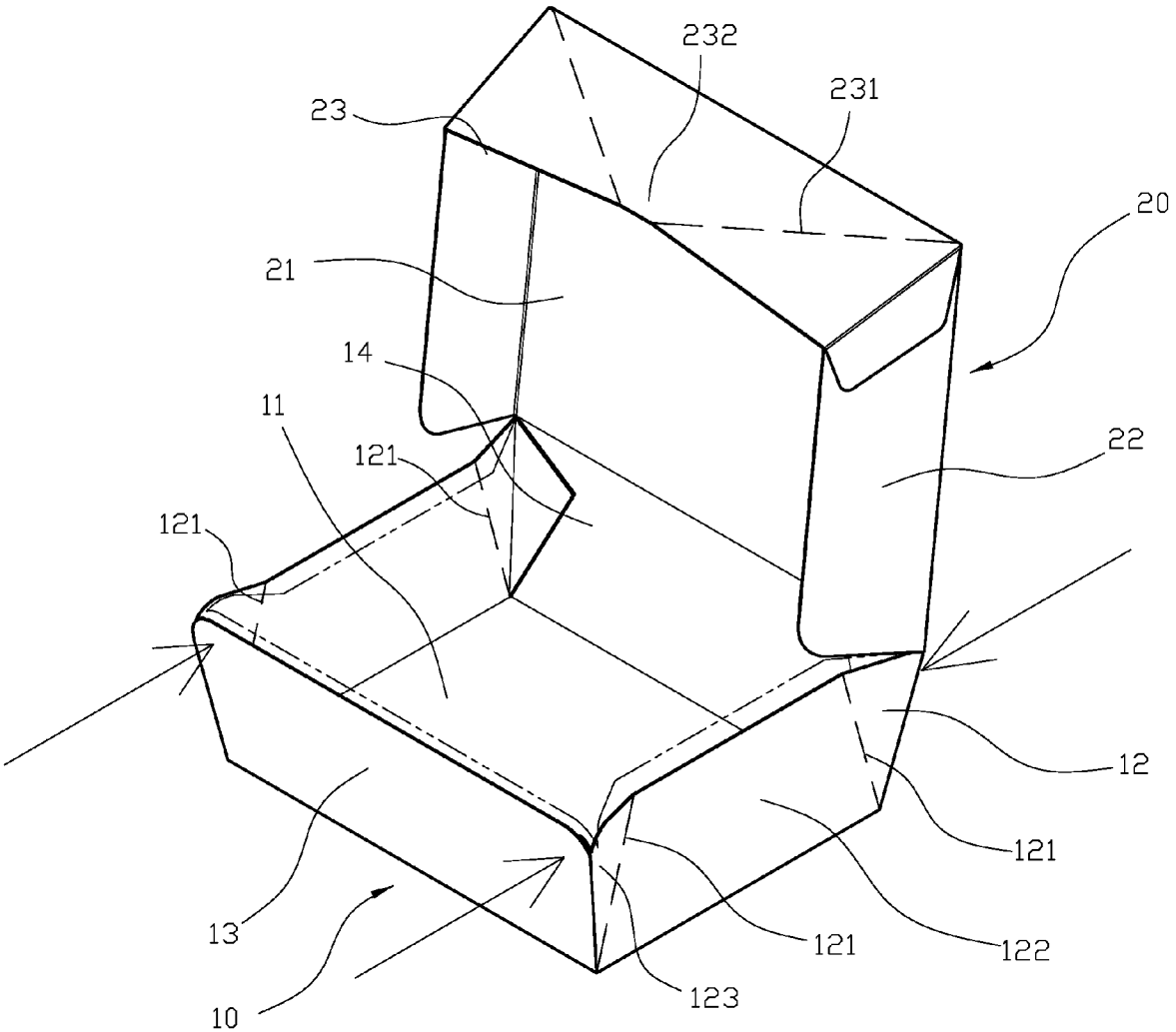
FIG. 4 illustrates a schematic view of the lunch box in the present invention.
Figure 5:
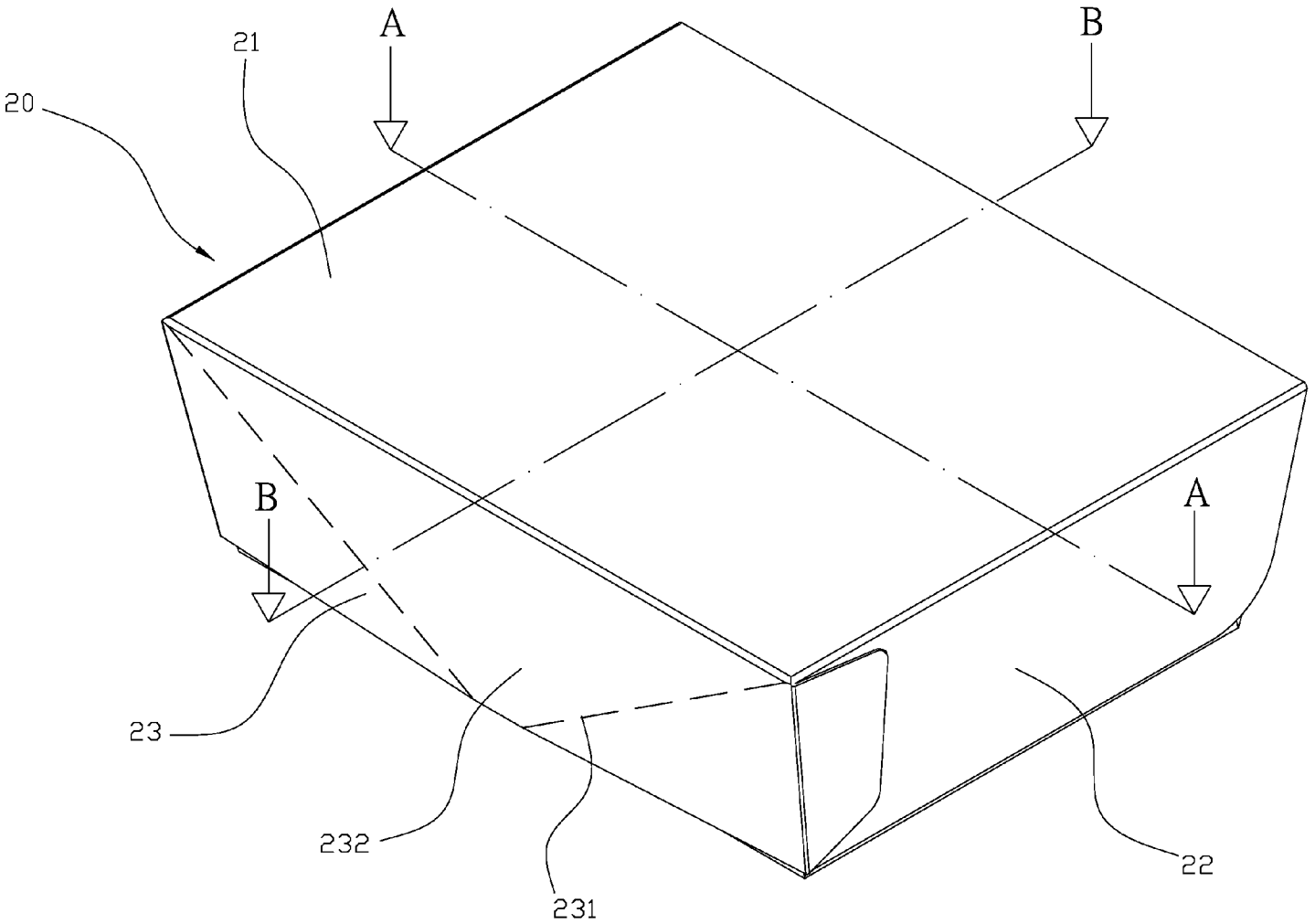
FIG. 5 illustrates a closed status of the lunch box in the present invention.
Figure 6:
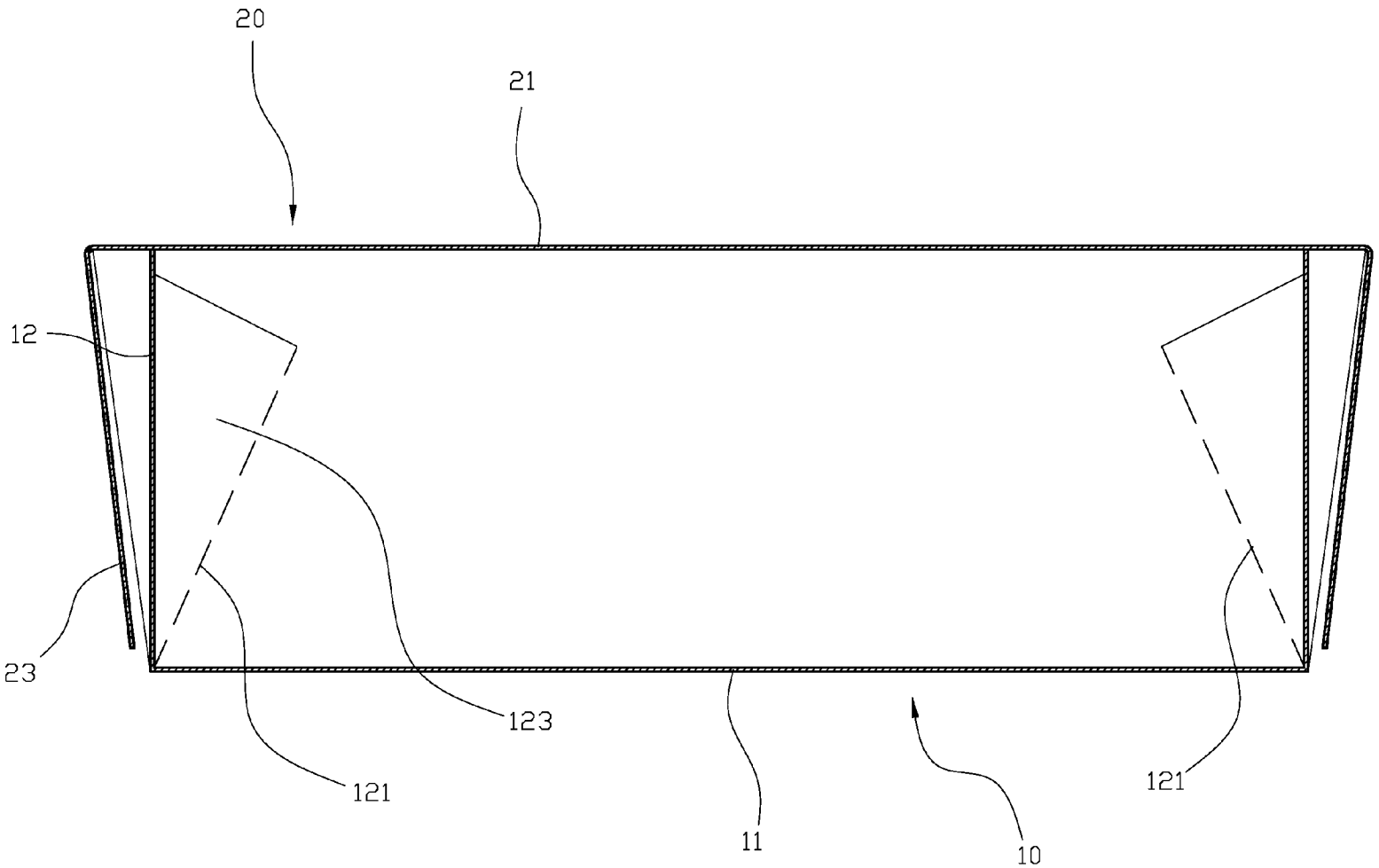
FIG. 6 illustrates a sectional view along line A-A' in FIG. 5.
Figure 7:
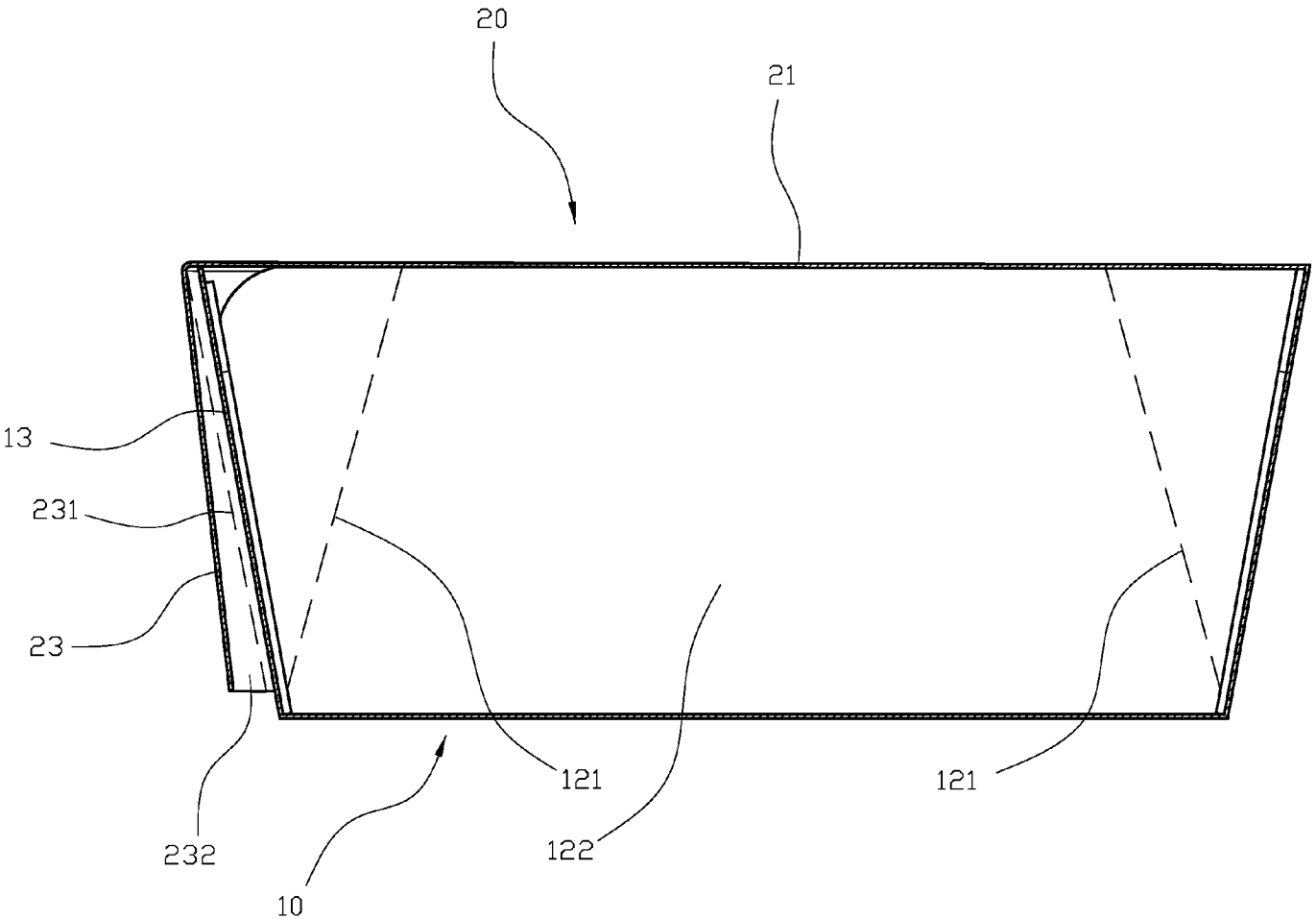
FIG. 7 illustrates a sectional view along line B-B' in FIG. 5.

In order to further understand the goal, characteristics and effect of the present invention, a number of embodiments along with the drawings are illustrated as following:

Referring to FIGS. 1 to 2, the present invention provides a lunch box structure including a main body (10) having a bottom portion (11), two side portions (12), a front portion (13) and a back portion (14) to define a receiving space (15). Two side portions (12) of the main body (10) extend from bottom part of the junction of the front portion (13) and the back portion (14) to form a first shaping line (121), and a retracting portion (122) is formed between two side portions (12) and two first shaping lines (121), and an expanding portion (123) is formed at the junction of first shaping lines (121) and the front portion (13). The front portion (13) and two side portions (12) are connected to outwardly form a tilted shape with an angle, and a cover (20) that is used to cover an upper portion of the main body (10) extends from the back portion (14), and cover (20) connects with the back portion (14) through an upper cover (21). Two side covers (22) vertically extend from both sides of the upper cover (21) of the cover (20), and are restricted outside two side portions (12) of the main body (10). A front cover (23) extends from front portion of the upper cover (21) and covers outside the front portion (13) of the main body (10), and the front cover (23) (from top to bottom) forms a retracting tilted shape corresponding to the front portion (13) of the main body (10). Also, two outer and upper portions of the front cover (23) extend toward the center to form two second shaping lines (231), and a lifting portion (232) is formed between a protruding portion of two second shaping lines (231) and the front portion (13).

Referring to FIGS. 3 to 7 for the structure of the lunch box, the receiving space (15) of the main body (10) is used to receive food, and the cover (20) is bended down through the back portion (14) to cover the lunch box, where the main body (10) is held and the front portion (13) is pushed inward, so that two side portions (12) are squeezed due to the shaping lines (121) and the retracting portion (122) is further retracted to enable the cover (20) to bend down to cover the box. Meanwhile, the side covers (22) and the front cover (23) respectively cover outside two side portions (12) and the front portion (13) of the main body (10), and the front portion (13) is restored when the retracting portion (122) of the side portions (12) rebounds, and the expanding portion (123) is outwardly against the junction of the front cover (23) and side covers (22) of the cover (20). Also, the front cover (23) of the cover (20) is tilted corresponding to the front portion (13), so when the front cover (23) covers outside the front portion (13) and is against the expanding portion (123), it cannot be open upward due to a restricting position formed by the retracting setting, and lunch box can be closed securely without external securing components or rubber bands.

Figure 8:
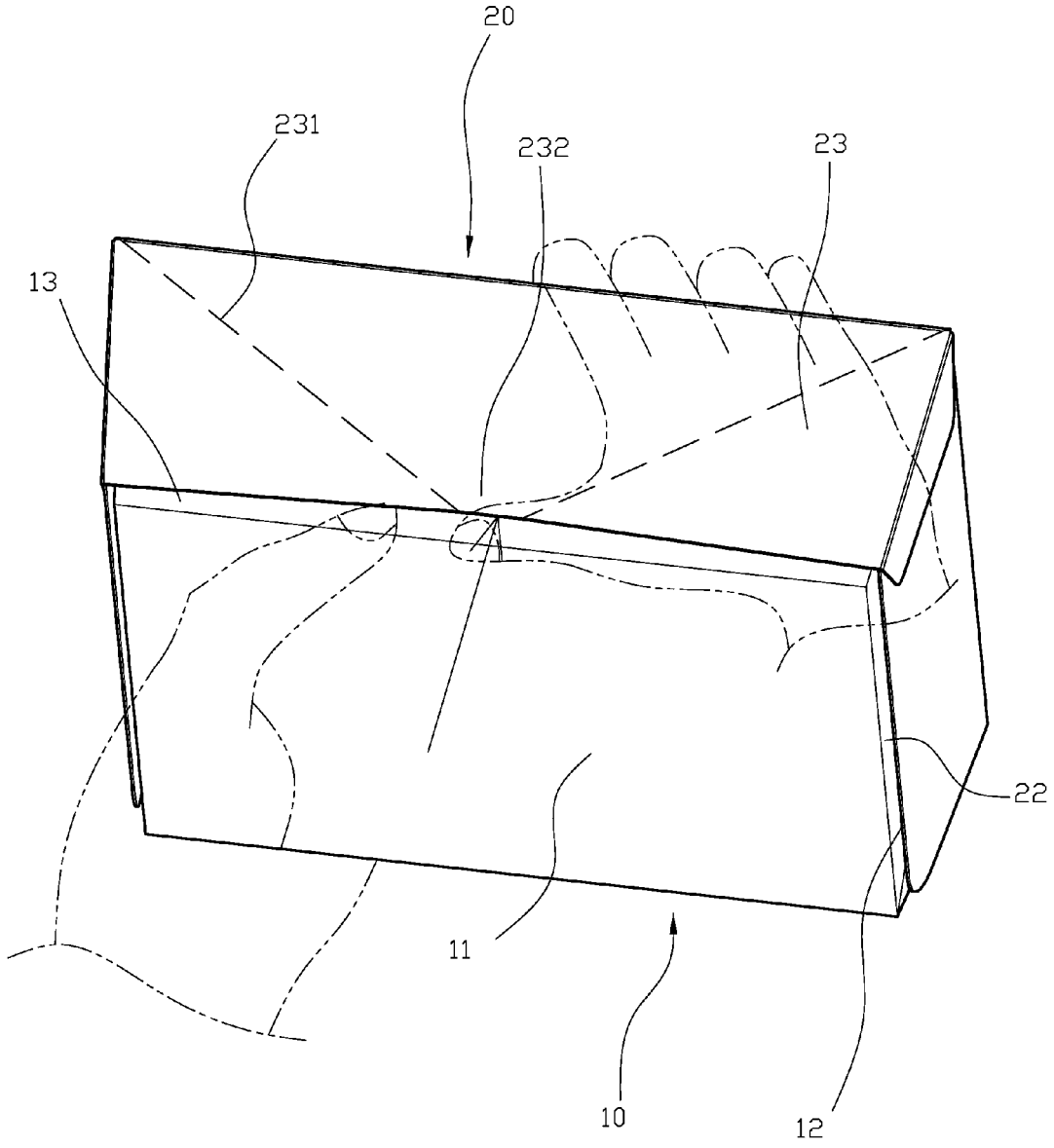
FIG. 8 illustrates an action view of the lunch box being open in the present invention.

On the contrary, when a user wants to lift the cover (20), referring to FIG. 8, the front cover (23) has two second shaping lines (231) at the central portion, and the lifting portion (232) is formed between two second shaping lines (231), so a space is formed between the front cover (23) and the front portion (13) to lift the cover (20) through the lifting portion (232).

According to the embodiments discussed above, the present invention is advantageous because (i) two side portions (12) of the present invention have two first shaping lines (121) from the front portion (13) and back portion (14) and form the retracting portion (122). When the cover (20) is bended down to cover the main body (10), two side portions (12) are retracted when the front portion (13) is pushed in corresponding to the first shaping lines (121). Meanwhile, side covers (22) on both sides are independent from two side portions (12), so the user can easily close the lunch box at a better angle to increase the convenience of the lunch box; and (ii) when the cover (20) is bended down to cover the main body (10), the front portion (13) is restored when the retracting portion (122) of the side portions (12) rebounds, and the expanding portion (123) is outwardly against the junction of the front cover (23) and side covers (22) to form a restricting position, so the lunch box can be closed securely without external securing components or rubber bands to reduce the material wastes and costs, and further achieve the goal of environmental protection.

Having described the invention by the description and illustrations above, it should be understood that these are exemplary of the invention and are not to be considered as limiting. Accordingly, the invention is not to be considered as limited by the foregoing description, but includes any equivalent.

What is claimed is:

1. A lunch box comprising a main body having a bottom portion, two side portions, a front portion and a back portion to define a receiving space, and a cover that is used to cover an upper portion of the main body connecting with and extending from the back portion of the lunch box, a method of closing the lunch box comprising steps of:

holding the lunch box and the receiving space facing upwards;

dividing each of the side portions into a retracting portion, an expanding portion and first shaping lines;

dividing the cover into an upper unit, two side units and one front unit; and pressing the front portion toward the back portion to enable the retracting portions to inwardly move to further bring down the cover, wherein the front unit of the cover is configured to be disposed outside of the front portion of the lunch box; two side units of the cover are configured to be disposed outside the side portions of the lunch box; and the upper unit is configured to be disposed on top of the receiving space of the lunch box.

2. The method of closing the lunch box of claim 1, further comprising s step of the front unit forming a retracting tilted shape corresponding to the front portion of the main body.

3. The method of closing the lunch box of claim 1, further comprising steps of forming two second shaping lines on the front unit and the forming a lifting portion to lift the cover between two second shaping lines.

4. The method of closing the lunch box of claim 1, wherein the first shaping lines are used to squeeze the side portions of the lunch box to enable the retracting portions to move inwardly.

5. The method of closing the lunch box of claim 1, further comprising a step of releasing the front portion to enable the front portion of the lunch box to be restricted by the front unit of the cover, and two side portions of the lunch box be restricted by two side units of the cover.

* * * * *